US006119424A

United States Patent [19]

Martin et al.

[11] Patent Number: 6,119,424

[45] Date of Patent: Sep. 19, 2000

[54] INSULATING MATERIAL

[75] Inventors: Raymond William Martin; Christopher Osmond, both of Cardiff, United Kingdom

[73] Assignee: Rockwool Limited, United Kingdom

[21] Appl. No.: 09/125,598

[22] PCT Filed: Feb. 20, 1997

[86] PCT No.: PCT/GB97/00470

§ 371 Date: Aug. 20, 1998

§ 102(e) Date: Aug. 20, 1998

[87] PCT Pub. No.: WO97/31164

PCT Pub. Date: Aug. 28, 1997

[30] Foreign Application Priority Data

Feb. 21, 1996 [GB] United Kingdom ..... 9603692

[51] Int. Cl.[7] ..... E04B 1/74

[52] U.S. Cl. ..... 52/407.3; 52/742.12; 52/406.2; 52/404.4

[58] Field of Search ..... 52/407.3, 407.2, 52/404.5, 404.3, 404.2, 407.4, 406.2, 742.12, 742.1

[56] References Cited

U.S. PATENT DOCUMENTS 4,151,692 5/1979 Holcombe ..... 52/404.3

4,303,713 12/1981 Clemensen et al. .

5,508,079 4/1996 Grant et al. ..... 52/406.2

5,545,453 8/1996 Grant ..... 52/406.2

FOREIGN PATENT DOCUMENTS 1091886 12/1980 Canada .

0125397 11/1984 European Pat. Off. .

96/05383 2/1996 WIPO .

*Primary Examiner*—Beth A. Stephan

*Assistant Examiner*—Dennis L. Dorsey

*Attorney, Agent, or Firm*—Ostrolenk, Faber, Gerb & Soffen, LLP

[57] ABSTRACT

A method of providing insulation between joists 31, 32 during building comprises unrolling a batt of mineral fibre which has, at least at its longitudinal edges, top 35, 45 and bottom 33, 43 layers. The bottom layer 33, 43 can be compressed to fit between joists, whilst the top layer 35, 45 extends across the joists, which adjacent strips 35, 45 abutting one another, to minimize cold bridging. The batt can be formed of two layers 33 and 35, 43 and 45 which may be manufactured by slitting a single web into two layers followed by winding the two layers together to form a roll.

18 Claims, 1 Drawing Sheet

INSULATING MATERIAL

The present invention relates to insulation formed of mineral wool provided in roll form and its use to insulate spaces between parallel joists and which minimises cold bridging effects.

It is well known to provide insulation formed of mineral fibre wools, for instance glass wool and rock wool, in roll form. It is known to provide the roll such that the batt of mineral wool is of a suitable width for fitting between joists, for instance ceiling joists in lofts, positioned at standard distances for instance 400 mm centres or 600 mm centres. One product which has been available for some time comprises a 100 m thick and 570 mm wide material wound into a roll. This provided adequate insulation to meet minimum requirements in the past. Building regulations have been increasing the requirements for minimum insulation and calculations of the insulation performance or "U values" must take into account the effect of thermal bridging at mortar joints, timber joists and studwork. This has meant that thermal bridging at ceiling joists should be minimised.

One way of improving the U values is to use thicker insulation between the joists, for instance 150 or 180 mm. However with the standard width roll the, even where the joists are of a lesser depth than the thickness of the insulation, cannot prevent thermal bridging. A roll formed of 150 mm thick homogenous batt can be adequately pushed between the joists to fill the gap, but the upper portion, extending above the joists cannot overlap the joists adequately to provide insulation above the joist.

Whilst increasing the thickness of a standard rectangular section batt to around 180 mm would provide adequate U values, single thickness of loft insulation greater than the height of the joist results in the insulation being compressed in thickness when it is installed under bracing timbers which are typically nailed across the tops of the ceiling joists to aid roof stability.

One solution to this problem is the Rockwool EnergySaver Super 150 mm loft insulation. This consists of a double layer of mineral wool wound in a single roll. The bottom layer is 100 mm thick, whilst the top layer is 50 mm thick. The roll is unwound in the normal manner so that the bottom 100 mm layer fits in the gap between joists. The top 50 mm layer is subsequently loosened and re-positioned by moving it sideways so that it overlies a joist. Top layers of adjacent strips are positioned so that their longitudinal edges abut one another. Since the roll is narrower than the distance between the joist centres (in order that the bottom layer fits between the joists) at least one additional strip of the top layer is required to cover the entire area over the joists. The two step laying procedure is, in addition, time consuming.

Another way of overcoming the problem of thermal bridging is disclosed in U.S. Pat. No. 4,303,713. The insulating material is again provided as two components. A first relatively wide length of insulating material has elongated slits and notches which act as scores to allow the strip to be folded into a U-shaped configuration so as to line the gap between joists. The top arms of the U can be folded over to form flanges on each side which overlie the joists and, optionally, overlap with the corresponding flange on the strip positioned in the adjacent space between joists. Into the U-shaped cavity is unrolled a second insulating layer. This solution is even more complex than the preceding one as it requires separate positioning of two different types of material and furthermore the provision of slits and notches increases the manufacturing complexity.

Another solution is disclosed in CA-A-1091886. A roll of material has a substantially T-shaped cross-section such hat the base part of the T sits between the joists, whilst the top flange sections extend over the top of the joists. The T-shaped batt can be made either by cutting notches along the longitudinal edges of a rectangular section batt, or may be made by lying a wider strip centrally on top of a narrower strip. Both methods of manufacture are relatively complex. In addition, when the batt is wound in a roll, the ends are not smooth and can become damaged, thereby damaging the flange sections which may reduce the insulation properties.

Flex-A-Batt is an insulation roll product made by Rockwool Limited and Rockwool International A/S which has improved flexibility such that when squeezed widthways, it retains some elasticity, exerting outwardly directed pressure, for instance on joists between which the batt is pushed. This allows a roll of material having a width equal to the distance between joist centres (400 mm or 600 mm, for instance) to be used to insulate between joists whereby improved properties of filling the gap and consequently of insulating performance are achieved.

The present invention provides a product which is simple to manufacture, which is quick and straightforward to lay and which provides high insulation performance by minimising thermal bridging at joists.

In a new method of providing insulation between sets of parallel joists having centre lines spaced X mm apart and having a height Y mm (having a gap of depth Y mm between them), a roll of mineral fibre wool which, when unwound and relaxed forms an elongated batt with substantially rectangular cross-section having width X to X+40 mm and a thickness of at least Y+50 mm and, along each longitudinal edge, comprises a top layer and a bottom layer defined by a split from the longitudinal edge to at least 15 mm inboard from the edge, the bottom layer being Y+25 mm thick and the top layer being at least 25 mm thick, is unwound such that the batt lies parallel to the joists and generally centred along the midway between a pair of joists and with the said bottom layer facing the joists, the bottom layer is then compressed widthwise towards the batt centreline to push the bottom layer into the space between the joists and the top layer lies across the tops of the joists on each side of the batt such that the top layers of adjacent batts abut each other along a line generally level with the joist centrelines (ie in a plane passing through the joist centreline perpendicular to the plane of the batt).

The provision of the split between top and bottom layers in the insulating batt allows the bottom layer to be widthwise compressible independently of the top layer. This allows the bottom layer to be squeezed so as to fit between the joists, whilst the top layer is not compressed so that it is not forced into the gap between joists. The split between top and bottom layers must reach to at least 15 mm in board of the longitudinal edge. The minimum width of the split depends, to an extent, on the difference between the thickness of the bottom layer and the height of the joists, as well as the difference between the relaxed width of the batt and the distance between joist centrelines, as well as the width of the joists themselves. The split has its smallest minimum when the thickness of the bottom layer is approximately equal to Y, the width of the batt is approximately equal to X and the joists are relatively narrow.

The split can be provided by forming a single cut, for instance, generally parallel to the plane of the batt, along the longitudinal edges of a generally rectangular batt, before forming it into a roll. Alternatively, but less preferably, a notch or slot can be cut into the side. Alternatively, and preferably, top and bottom layers are entirely separate layers. These may be provided during manufacture either by aligning two batts of equal width and rolling them together. Alternatively a single batt can be slit during manufacture and immediately rolled.

The bottom layer generally has a thickness as close to the height of the joist as possible. Preferably within 10 mm of the joist height. Currently in new build houses in the UK, there are two standard heights, 75 mm and 100 mm. Consequently, the bottom layer preferably has a thickness of 50–125 mm, more preferably 65–110 mm, for instance about 75 mm or about 100 mm.

The top layer should have a minimum thickness such that when top layers of adjacent batts abutting one another overlie a joist, the thickness across the joist is adequate to minimise thermal bridging. A suitable minimum thickness is 25 mm, whilst the top layer is preferably at least 50 mm thick. The total thickness of the batt should generally be at least 100 mm, more preferably at least 120 mm, most preferably at least 135 mm thick. It is preferable for the total thickness to be less than 175 mm, most preferably less than 160 mm.

The width of the batt must be at least X, X being the distance between joist centre lines. This allows top layers of batts between adjacent gaps to abut one another without the top layer having to be translated (ie moved sideways) from its original position. The total width is generally no more than 30 mm greater than X, preferably no more than 20 mm greater than X, and preferably less than 10 mm greater than X.

The mineral wool may be glass wool or, more preferably, rock wool. The density should preferably be in the range 10 to 30 kg/m$^3$, more preferably in the range 19 to 27 kg/m . The wool preferably is flexible and resilient, so that it can be squeezed widthwise and retain elasticity so that it presses against the joists between which it is pushed.

The invention is illustrated further in the accompanying drawings in which.

Figure 1:
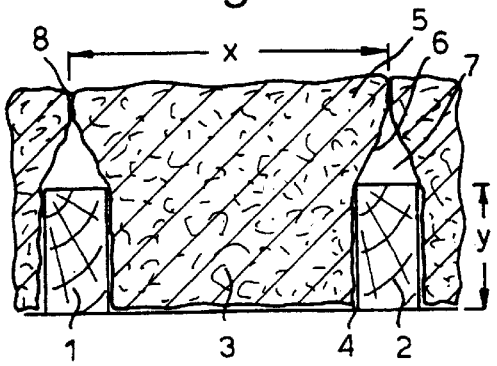
Fig.1. PRIOR ART
FIG. 1 is a section through a pair of joists showing the problem with provision of a uniform thick batt of mineral wool.

FIG. 1 shows the problem with one aspect of the prior art. A pair of joists 1, 2 having a height Y mm and a distance X between the centre lines are provided with a batt of insulation 3 which is, before being positioned between the joists, of substantially rectangular section having a width approximately X mm (for instance 400 or 600 mm), and a thickness of, in this case, 150 mm. The batt fills the gap 4 between the joists 1 and 2 but the top region 5 of the batt is compressed inwards at 6 so as to leave an air gap above the joist 2. Air gaps above or adjacent to the joists are not good practice as they result in cross ventilation between eaves thus reducing the insulation value. The thickness of the insulation along the abutting line 8 above the joist 1 is insufficiently thick and leads to thermal bridging.

Figure 2:
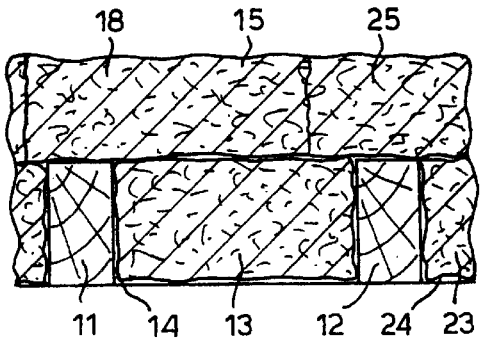
Fig.2. PRIOR ART
FIG. 2 is a section through a pair of joists showing the positioning of EnergySaver Super 150 mm loft insulation.

FIG. 2 shows the solution to the problem provided in the prior art by EnergySaver Super 150 mm loft insulation. The gap between joists 11 and 12, having height Y mm, is filled with a bottom layer of insulation 13, having a thickness of about Y mm. The relaxed width of the layer 13 is somewhat less than X mm, but more than the distance separating facing sides of joists 11 and 12. The layer 13 adequately fills the gap 14 between joists 11 and 12. The batt 13 is provided as one layer of a double layer from a single roll, the upper layer being a batt 15 of the same material having the same relaxed width as the batt 13. The dual layer is provided by slitting a single, rectangular section batt parallel to the plane of the batt before winding it into the roll. The top layer 15 is unwound with batt 13 but is subsequently loosened and moved sideways so that it overlies joist 11. The total thickness of insulating material above the joist 11 at 18 is relatively high so that there is minimal thermal bridging. However as can be seen, in the adjacent gap between joists, 24, a batt of insulating material 23 is positioned, whilst the associated top layer 25 is again moved (to the left in the drawing) to overlie joist 12. This top batt 25 is positioned even further to the left relative to associated bottom layer 23 since the relaxed width of the batts 15 and 25 is less than the distance X between joists. consequently at least one extra strip of top layer must be provided to complete the insulation. In addition the two-step fitting procedure, in which the top layers 15 and 25 have to be repositioned after bottom batts 13 and 23 have been pushed between the joists, is time consuming.

Figure 3:
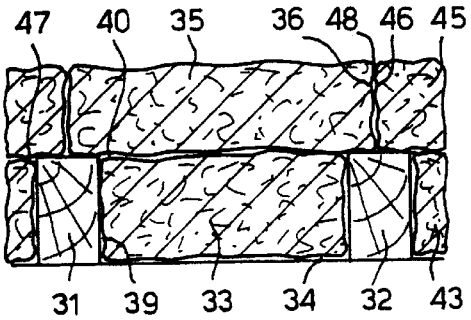
FIG. 3 shows a section through two joists provided with insulation according to one embodiment of the present invention.

FIG. 3 shows one embodiment of the present invention and its use to insulate between joists 31, 32. The joists have a distance X between their centres lines, in this case 600 mm. The joists are Y mm deep, in this case 75 or 100 mm deep. The batt of insulation consists of a bottom layer 33 and a top layer 35 which, when relaxed, have the same width, namely 600 mm. Both top and bottom layers have a thickness of about 75 mm. Other thickness and combinations of thicknesses can be used. For instance where the joists are 100 mm high, the top layer 35 may have a thickness of about 50 mm and the bottom layer 33 may have a thickness of about 100 m. The density of both layers is the same and is in the range 19 to 27 kg/m$^3$.

The two layers are wound together onto a roll and are positioned by unrolling along the gap between joists 31, 32. The bottom layer 33 is compressed inwardly to fit in the space 34 between the joists. The mineral wool is sufficiently resilient that the longitudinal edges of the bottom layer, 39, push against the joists 31 and 32. The top layer, 35, is not pushed between the joists. Since the relaxed width of the batt is about the same as the distance between the joist centre lines, the edge 36 of the top layer 35 overlies joist 32 up to approximately its centre line. The longitudinal edge 36 abuts the edge 46 of top layer 45 associated with bottom layer 43 of an adjacent batt 45 positioned between joist 32 and the adjacent joist (not shown). As can be seen, the total thickness of insulation above the joist along abutting edges 36 and 46 of top layers 35 and 45 is the thickness of the top layer itself, in this case 75 mm.

In this first embodiment, the slit, 40 between the bottom layer 33 and top layer 35 of the insulating batt extends across the entire area of the batt. In this embodiment, since the thickness of the bottom layer is about equal to the height of the joist 31, there is no air-gap or a minimal air-gap 47 at the corner of the joist thus minimising cross ventilation. Further since the total thickness of insulation above the joist at 48 is relatively high, thermal bridging is minimised.

Figure 4:
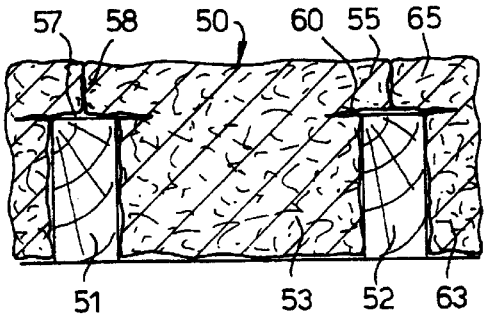
FIG. 4 represents a section through a pair of joists showing the provision of insulation according to a second embodiment of the invention.

In an alternative embodiment of the invention shown in FIG. 4, insulating material 50 is provided between joists 51 and 52 having X mm centres and a height of Y mm (X and Y being, in this case, 600 m and 100 mm respectively). The insulating batt 50, along its longitudinal edges, consists of a bottom layer 53 and a top layer 55 having between them a slit 60 formed by cutting the material parallel to the major face of the batt from the edge to a distance about 50 mm inboard from the edge. This slit allows the bottom layer 53 to be compressed inwards to fit between joists 51 and 52 without causing the top layer 55 to be pulled inwards. Top layer 55 abuts top layer 65 of adjacent batt having bottom layer 63, so that the total thickness above the joist 51, shown at 58, is adequately thick to provide minimum thermal bridging. In this embodiment, the bottom layer 53 is about equal in thickness to the height of the joists 51 and 52. Consequently there is no air-gap or minimal air-gap 57 above the joist 51. Furthermore, the thickness at 58 is greater than at 8 shown in FIG. 1, illustrating the problem solved by the invention, even though the total thickness of insulation in this embodiment of the invention is lower. Thermal bridging is consequently lower in the invention than in the prior art.

Figure 5:
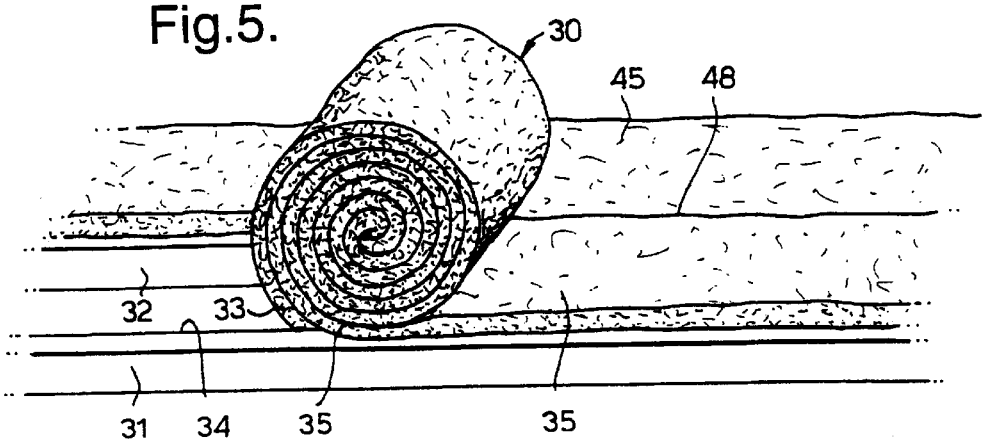
FIG. 5 is a perspective view showing the unrolling of a batt according to the first embodiment of the invention.

FIG. 5 shows how the insulating material of the first embodiment is placed in position. A roll 30 of rock wool batt consists of two layers 33 and 35 wound together onto the roll. This dual layer product is for instance made by splitting a single layer into two before winding it to form a roll. The single layer may be made by the process described in DE-A-3703622 whereby the flexibility of the batt is controlled by partial crushing of the binder. The roll may be substantially as used for EnergySaver Super 150 mm loft insulation.

As the roll is unwound, bottom 33 provided on the outside of the roll, is positioned between joists 31 and 32, being squeezed to fill the gap 34 between the joists. Top layer 35, co-wound with bottom layer 33 lies on top of bottom layer 33 and, being the same width as the distance between joist centrelines, extends on each side to approximately the joist centreline. In FIG. 5, insulation 43, 45 has already been positioned between the joist 32 and adjacent joist (not shown). The insulation consists of top layer 45 and bottom layer 43 which has been squeezed between the joists. Top layers 35 and 45 meet at 48 which is level with the joist centrelines (that is vertically above joist centreline).

What is claimed is:

1. A method of providing insulation between sets of parallel joists (31, 32, 51, 52) having a center line spaced X mm apart and being Y mm high, where X is about 400 or about 600 and Y is in the range of 75 to 100, comprising providing a roll (30) of mineral fibre wool which, when unwound and relaxed, forms an elongated batt with rectangular cross-section having width in the range X to X+40 mm and a thickness of at least Y+50 mm, and which along each longitudinal edge comprises top layer (35, 55) and a bottom layer (33, 53) defined by a split (40, 60) which extends between the top and bottom layers from the said edge to at least 15 mm in board of the edge, the bottom layer being in the range Y±25 mm thick and the top layer being at least 25 mm thick and the top and bottom layers having the same width which is in the range X to X+40 mm and having the same density unwinding the roll such that the batt lies parallel to the joist centered generally along the line midway between a pair of joists, and with the said bottom layer facing the joists, and compressing the bottom layer inwards toward the centerline to fit the bottom layer between the joists whilst the top layer is not compressed and lies on top of each of the pair of joists such that the top layers of adjacent batts abut each other generally level with the joist centrelines.

2. A method according to claim 1 in which the split (40) extends across the entire width of the batt.

3. A method according to claim 1 in which the bottom layer is in the range Y±10 mm thick.

4. A method according to claim 1 in which the width of the batt is in the range X to X+10 mm.

5. A method according to claim 1 in which the total thickness of the batt is in the range 125 to 175 mm.

6. A method according to claim 1 in which X is about 400 mm or about 600 mm and Y is in the range 75–100 mm.

7. A method according to claim 1 in which the top layer is at least 50 mm thick.

8. A method according to claim 1 in which the bottom layer is about 75 mm or about 100 mm thick.

9. A method according to claim 1 in which the mineral wool consists of rock wool having a density in the range 19 to 27 $kg/m^3$.

10. A method according to claim 1 in which the top layer is about 50 mm thick.

11. A method according to claim 1 in which the top layer is about 75 mm thick.

12. A method according to claim 1 in which the split between top and bottom layers extends at least 20 mm inboard of the said longitudinal edge.

13. A method according to claim 12 in which the split between the top and bottom layers extends at least 50 mm in board of said longitudinal edge.

14. A method according to claim 13 in which the split extends across the entire width of the batt.

15. A method according to claim 14 in which the top layer is about 50 mm thick.

16. A method according to claim 14 in which the top layer is about 75 mm thick.

17. A method according to claim 12 in which the split between the top and bottom layers extends at least 30 mm in board of said longitudinal edge and in which the total thickness of the batt is in the range 140–160 mm.

18. A method according to claim 17 in which the split extends across the entire width of the batt.

* * * * *